US006629797B1

(12) United States Patent
Lee

(10) Patent No.: US 6,629,797 B1
(45) Date of Patent: Oct. 7, 2003

(54) WRITING IMPLEMENT HAVING A BAR TYPE LEAD ELEMENT AND MOLDING METHOD OF THE LEAD ELEMENT THEREIN

(75) Inventor: Eun-sung Lee, Seoul (KR)

(73) Assignee: Amos Corporation, Seoul (KR)

( * ) Notice: Subject to any disclaimer, the term of this patent is extended or adjusted under 35 U.S.C. 154(b) by 45 days.

(21) Appl. No.: 10/329,492

(22) Filed: Dec. 27, 2002

(30) Foreign Application Priority Data

Sep. 6, 2002 (KR) ..... 10-2002-0053902

(51) Int. Cl.[7] ..... B43K 21/08

(52) U.S. Cl. ..... 401/78; 401/55; 401/68; 401/87; 424/64; 106/38.2

(58) Field of Search ..... 401/49, 55, 58, 401/61, 63, 64, 68, 75–78, 87, 88, 99, 107, 116; 106/38.2; 424/64

(56) References Cited

U.S. PATENT DOCUMENTS 5,829,901 A * 11/1998 Brown et al. ..... 401/88
5,902,061 A * 5/1999 Ackermann et al. ..... 401/68
6,186,686 B1 * 2/2001 Neuner et al. ..... 401/75
6,497,523 B1 * 12/2002 Kuroiwa et al. ..... 401/55

* cited by examiner

*Primary Examiner*—Tuan N. Nguyen
(74) *Attorney, Agent, or Firm*—Dickstein Shapiro Morin & Oshinsky, LLP

(57) ABSTRACT

A writing implement has a bar type lead element, a container formed as a hollow member having one and opposite ends being open, a supporting shaft inserted in the container to be moved therein linearly in an axial direction, the supporting shaft being formed as a hollow member having a center hole pierced therethrough, and an adjustment member movably connected to a rear end of the container to be rotated, the rotation of the adjustment member causes the supporting shaft to be linearly moved in the container, the adjustment member being formed as a hollow member having one and opposite ends being open to be in fluid communication with the center hole 42. Accordingly, the raw material of the lead element is injected into the container from a rear end of the adjustment member through the center hole, and solidifies into the lead element, and the lead element is supported on the front end of the supporting shaft at its rear end, and moved in accordance with the movement of the supporting shaft. Accordingly, the raw material in melt state can be injected into the container with all the main parts being assembled in place. As a result, the manufacturing process becomes simplified, and the automation of assembly line can be achieved easily.

12 Claims, 9 Drawing Sheets

WRITING IMPLEMENT HAVING A BAR TYPE LEAD ELEMENT AND MOLDING METHOD OF THE LEAD ELEMENT THEREIN

CROSS-REFERENCE TO RELATED APPLICATIONS

This application claims the benefit of Korean Patent Application No. 2002-53902, filed on Sep. 6, 2002, in the Korean Intellectual Property Office, the disclosure of which is incorporated herein by reference.

BACKGROUND OF THE INVENTION

1. Field of the Invention

The present invention generally relates to a writing implement having a structure that advances and retreats a bar type lead element into or out of a container, and more particularly, it relates to a writing implement having a structure that enables simple manufacturing process and automation of the manufacturing line, the writing implement having a tip end of the lead element molded into a smooth and complete shape, and the writing implement having a bar type lead element rendering no waste during advance and retreat, and a molding method of the lead element therein.

2. Description of the Prior Art

Generally, a writing implement having a bar type lead element therein has a structure in which the lead element is movably disposed inside of a column type hollow container to be advanced and retreated. When in use, the lead element is advanced out of the container, and then retreated into the container after the writing is finished.

For the advance and retreat of the lead element, the conventional writing implement includes a lead element supporting means that is linearly moved along the inside of the container, and an adjustment means that is rotatably connected to an end of the container and screw-engaged with the lead supporting means. Meanwhile, provided on the outer circumference of the lead supporting means are a plurality of grooves, while a plurality of corresponding protrusions are formed on the inner circumference of the container in an axial direction. Accordingly, as the protrusions are slid along in contact with the grooves, the lead supporting means is moved inside of the container in a linear direction.

Since the lead supporting means is screw-engaged with the adjustment means, the lead supporting means is subject to a propelling force in the axial direction when the adjustment means is rotated. And since the protrusions of the lead supporting means are in contact with the grooves of the container, the lead supporting means is linearly moved inside of the container in an axial direction, instead of being rotated. Accordingly, the bar type lead element, which is connected with the lead supporting means, is either advanced out, or retracted into the container.

Meanwhile, the bar type lead element is shaped by cooling thus solidifying the high temperature raw material in melt state at a room temperature. More specifically, a nozzle is inserted into the container to inject the melt raw material therethrough. Then by cooling the raw material in the container, the raw material solidifies into the shape identical to that of the interior of the container.

One example of conventional method of forming the lead element for the writing implement is as follows. First, with the lead supporting means being assembled with the adjustment means, the assembled lead supporting means and the adjustment means are connected to the rear end of the container. Next, the container is made stand upright with its front end facing upward, and the nozzle is inserted into the container through the front end of the container. Then, the raw material in melt state is injected into the container through the nozzle, and solidifies into the complete lead element.

However, according to the conventional method for forming the lead element, after the solidification of the raw material, the leading end of the lead element is formed plane. As the plane tip end of the lead element is not appropriate for writing, it is necessary to sharpen the leading end of the lead element. Accordingly, the manufacturing process becomes complex, and the automation of the manufacturing process is hardly achieved.

As another example of the conventional method of forming the lead element, there was a method that a pointed cap is connected to the front end of the container and the container is made stand upright with its front end and the pointed cap facing downside. Then the nozzle is inserted into the container through the rear end of the container, and the raw material in melt state is injected through the nozzle and solidifies therein.

By the above method, since the leading end of the lead element is formed inside of the pointed cap into a rounded point, requirements for the process of sharpening the leading end of the lead element after the solidification can be omitted. However, this method has the following drawbacks.

According to the second example of the conventional lead element forming methods, the lead supporting means is assembled in the container only after the injection of the melt raw material. Accordingly, the lead supporting means has to be assembled in the container immediately after the injection of the raw material into the container. The problem is that the assembling process of the lead supporting means and the container requires manual work, as it requires personal attention to accurately fit the grooves on the outer circumference with the protrusions formed on the inner circumference of the container. In other words, the assembling process can hardly be automated, and thus, efficiency in this process cannot be expected.

Further, in the case that the assembling of the lead supporting means is delayed, i.e., in the case that the lead supporting means is assembled after the raw material already solidifies to some extent, the lead supporting means and the container can be assembled incompletely, and as a result, the lead element can not be supported stably by the lead supporting means. With the lead element being supported by the lead supporting means unstably, the lead element is easily escaped out of the lead supporting means during the retreat because of the frictional force generated between the outer circumference of the lead element and the inner circumference of the container.

Meanwhile, the conventional writing implement constructed as above also has a problem of having a waste, such as the scrapes of the lead element during a movement of the lead element by the friction with the inner surface of the container.

More specifically, the conventional writing implement has the protrusions formed in an axial direction along the inner circumference of the container, another protrusions formed on the outer circumference of the lead supporting means for being connected with the protrusions of the container, and still another protrusions formed in an axial direction along the outer circumference of the lead element that has the corresponding shape as that of the inner circumference of the container. Further, being screw-engaged with the adjustment means, the lead supporting means is subject to the rotational force as well as to the propelling force when the adjustment means is rotated. The rotational force is exerted to the lead supporting means in a forward direction when the lead element is advanced, and then exerted in the opposite direction when the lead element is retreated. Meanwhile, the grooves of the lead supporting means and the protrusions of the container are formed at certain clearance. Accordingly, during the advance and retreat of the lead element, the lead element is subject to a pressure by the protrusions of the container in one and opposite directions as much as the distance of the clearance. As the lead element is pushed against the grooves, the lead element often collapses or its outer surface breaks off.

Further, the outer circumference of the lead element is concaved for an engagement with the inner circumference of the container. Thus, when the lead element is advanced out of the container, the writing implement has a degraded appearance due to such concaved surface.

SUMMARY OF THE INVENTION

The present invention has been made to overcome the above-mentioned problems of the prior art, and accordingly, it is an object of the present invention to provide a writing implement enabling a simple manufacture and an automation of assembly line by having all the required parts being assembled in place when injecting a raw material in melt state into a container, and starting charging of the raw material from an inner end of a cap, and a method of forming the lead element therein.

The above object is accomplished by a writing implement having a bar type lead element according to the present invention, including a bar type lead element being formed as a raw material in melt state solidifies, a container formed as a hollow member having one and opposite ends being open; a supporting shaft inserted in the container to be moved therein linearly in an axial direction, the supporting shaft being formed as a hollow member having a center hole pierced therethrough; and an adjustment member movably connected to a rear end of the container to be rotated, the rotation of the adjustment member causes the supporting shaft to be linearly moved in the container, the adjustment member being formed as a hollow member having one and opposite ends being open to be in fluid communication with the center hole 42. The raw material of the lead element is injected into the container from a rear end of the adjustment member through the center hole, and solidifies into the lead element, and the lead element is supported on the front end of the supporting shaft at its rear end, and moved in accordance with the movement of the supporting shaft.

The supporting shaft is screw-engaged with the adjustment member to be linearly moved in the axial direction inside of the container in accordance with the rotational movement of the adjustment member.

More specifically, the supporting shaft includes a shaft portion having a spiral groove formed in an outer circumference, and a supporting portion connected to a front end of the shaft portion with an outer circumference being in contact with the inner circumference of the container and not allowed to rotate but only allowed to move in a linear direction, while the adjustment member includes a spiral protrusion formed in a front end for being inserted in the spiral groove. Accordingly, as the spiral protrusion moves along the spiral groove by the rotation of the adjustment member, and the supporting shaft is not rotated but moved linearly in the axial direction inside of the container.

Since the outer circumference of the supporting portion and the inner circumference of the container are formed in a polygonal shape, the supporting portion, being inserted in the container, is only allowed to move in the axial direction.

The supporting portion includes an accommodating recess for accommodating a rear end of the lead element, and a through hole in fluid communication with the accommodating recess, the accommodating recess and the through hole being filled with a raw material of the lead element.

Further provided is a cap formed as a hollow member having an open rear end and a closed front end, for accommodating the container therein. The cap includes a recess formed in an inner side of the front end, having a shape corresponding to a shape of the leading end of the lead element.

According to the present invention, the writing implement can further include a plug for sealing the rear end of the adjustment member, the plug having a projection protruding from the center for being inserted into the center hole of the supporting shaft.

The above object is also accomplished by a method for forming a lead element according to the present invention, including the steps of: rotatably assembling an adjustment member to a rear end of a container, the container being formed as a hollow member having one and the opposite end open, the adjustment member being formed as a hollow member having one and the opposite end open; inserting a supporting shaft in the container from the front direction in a manner such that the supporting shaft is moved in the container, the supporting shaft being formed as a hollow member having a hole being pierced therethrough; screw-engaging the adjustment member with the supporting shaft in a manner such that the supporting shaft is linearly moved in the container in accordance with the rotation of the adjustment member; sealing the container by covering the front end of the container with a cap; inserting a nozzle in the container through the supporting shaft from the rear direction of the adjustment member, the nozzle for injection of a raw material of the lead element in melt state; injecting the raw material of the lead element in melt state in the container through the nozzle; and forming a bar type lead element by solidifying the raw material of the lead element injected into the container.

The lead element is formed in the shape corresponding to the inner shape of the container, with a leading end being formed in accordance with a recess of the cap that is formed in an inner side of an end of the cap, and a rear end being secured to the front end of the supporting shaft.

In the raw material injection step, the raw material of the lead element in melt state is injected into the container, with the nozzle, which is inserted to the proximity of the front end of the container, being retreated from the proximity of the front end of the container to the front end of the supporting shaft.

After the injection of the raw material, the rear end of the adjustment member is sealed by a plug.

With the writing implement having the bar type lead element and the molding method of the lead element therein according to the present invention, the raw material in melt state can be injected with all the main parts, i.e., the supporting shaft, the adjustment member and the cap, being assembled with the container. As a result, the manufacturing process becomes simplified, and the automation of assembly line can be achieved easily.

Further, according to the present invention, the recess having a certain configuration desired for the shape of the leading end of the lead element is formed in the inner side of the end of the cap. As the raw material is injected in the container, it enables easy achievement of the simplification of the manufacturing process and assembly line automation. Additionally, the leading end of the lead element can be molded to have a smooth and complete shape as that of the configuration of the recess of the cap.

In the writing implement according to the present invention, the supporting shaft and the lead element have the polygonal sections corresponding to the inner configuration of the container. As the supporting shaft and the lead element are connected in the container to be movable therein and with the polygonal sections thereof being aligned with one another, the lead element does not experience excessive pressure during advance and retreat, and as a result, deformation of the lead element and the undesired fragment of the lead element from the breakage, can be prevented.

BRIEF DESCRIPTION OF THE DRAWINGS

The above objects and characteristics of the present invention will be more apparent by describing the preferred embodiment of the present invention in detail with reference to the accompanying drawings, in which.

DETAILED DESCRIPTION OF THE PREFERRED EMBODIMENT

Hereinafter, the preferred embodiment of the present invention will be described in greater detail with reference to the accompanying drawings.

Figure 1:
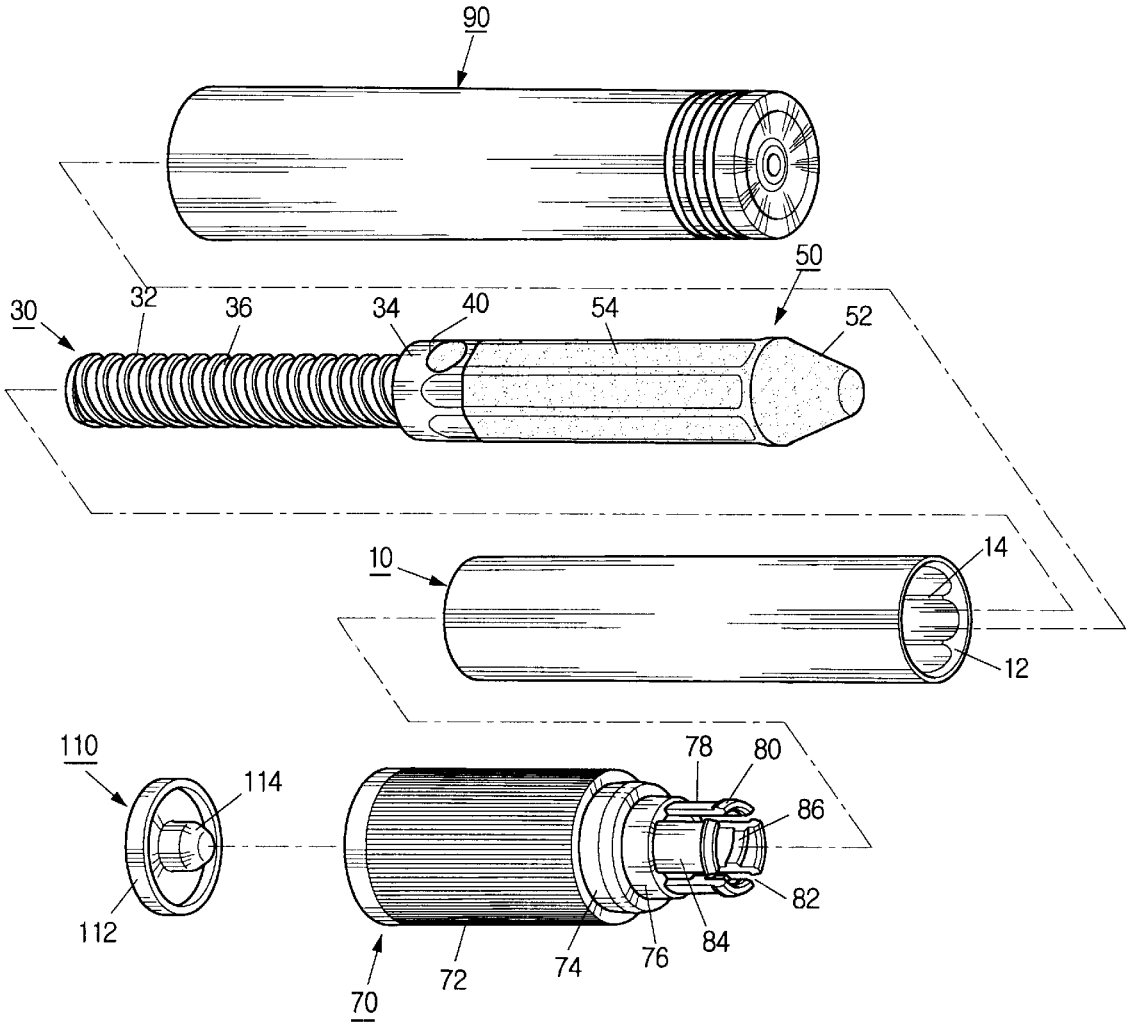
FIG. 1 is an exploded perspective view of a writing implement according to a preferred embodiment of the present invention.
Figure 2:
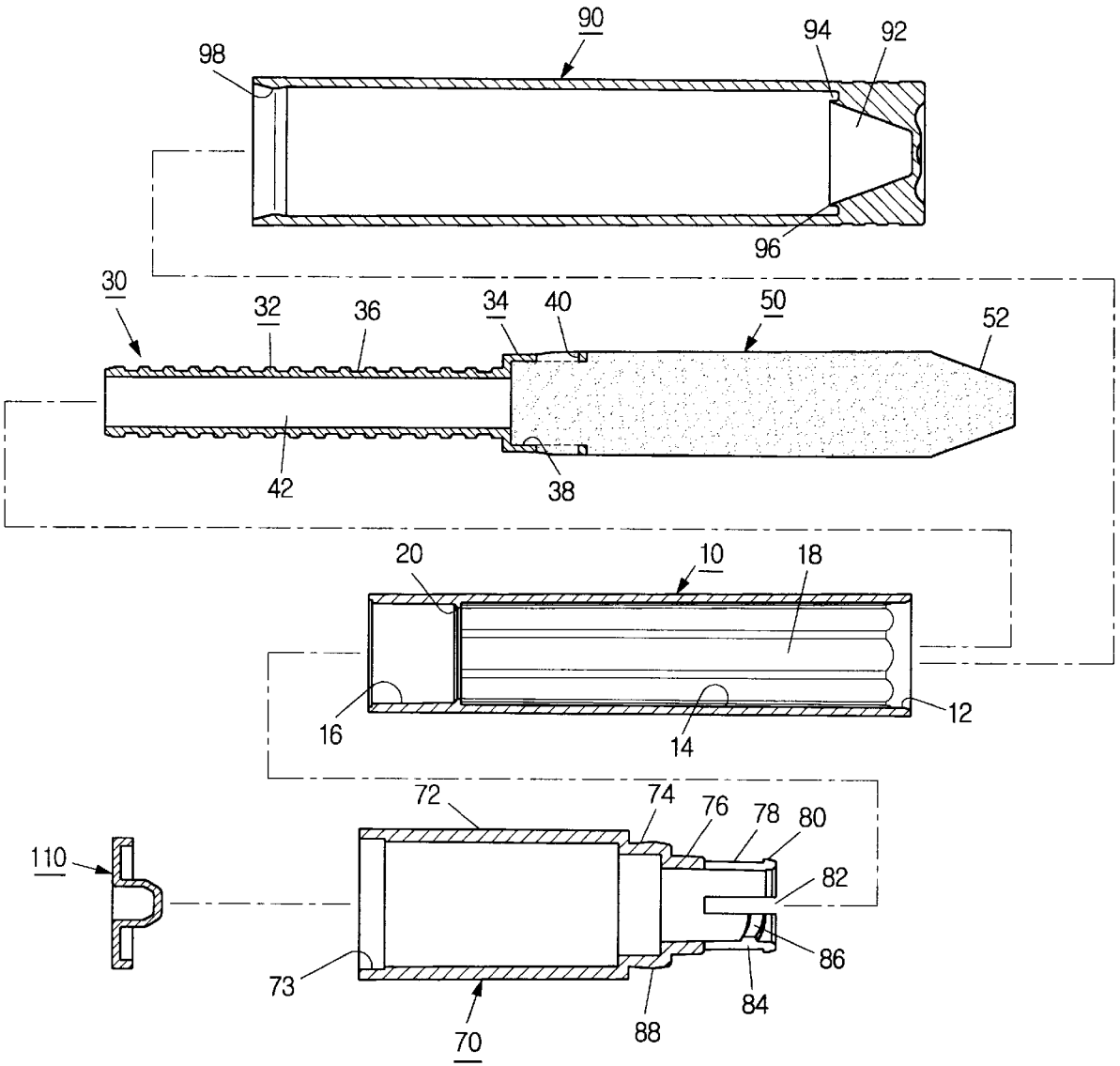
FIG. 2 is an exploded sectional view of a writing implement according to a preferred embodiment of the present invention.

FIGS. 1 and 2 are, respectively, an exploded perspective view and an exploded sectional view showing the structure of the writing implement according to the preferred embodiment of the present invention. Hereinbelow, the direction where a leading end 52 of a lead element 50 faces will be called front direction, while the opposite direction will be called rear direction.

As shown in FIGS. 1 and 2, the writing implement according to the present invention mainly includes a container 10, a supporting shaft 30, a lead element 50, an adjustment member 70, a cap 90 and a plug 110. In this embodiment, the container 10, the supporting shaft 30, the adjustment member 70, the cap 90 and the plug 110 are made of plastics.

The container 10 is made as a hollow cylinder with one and the opposite ends being open. From front to the rear ends, the interior of the container 10 includes a first inner diameter portion 12, a second inner diameter portion 14 and a third inner diameter portion 16.

The first inner diameter portion 12 is formed to have a smooth surface, i.e., have no concaves on the surface.

The second inner diameter portion 14 is formed to have a polygonal section, and extended from the first diameter portion 12 to a predetermined distance. The second inner diameter portion 14, having the polygonal section, hinders the rotation of the lead element 50, while simultaneously guiding the movement of the lead element 50 in an axial direction. The section of the second inner diameter portion 14 is preferably hexagon or octagon, because the hexagonal or octagonal section is close to a circle which has a pleasing appearance, while it also ensures guidance of the lead element 50 in axial direction. This embodiment adopted the second inner diameter portion 12 having octagonal section.

The polygonal section of the second inner diameter portion 14 is formed such that it has an external circumscription as large as the diameter of the first inner diameter portion 12. Accordingly, a circle connecting the vertices of the polygonal section of the second inner diameter portion 14 has the same diameter as that of the first inner diameter portion 12, while the inner circle circumscribed by the respective straight sides between the vertices has the diameter smaller than that of the first inner diameter portion 12.

The third inner diameter portion 16 is extended from the second inner diameter portion 14 toward the rear end of the container 10. Formed at a linking part between the second and the third inner diameter portions 14, 16 is an annular protrusion 20.

The supporting shaft 30 includes a shaft portion 32, and a supporting portion 34 extended from the shaft portion 32 toward the front end. On the outer circumference of the shaft portion 32 is formed a spiral groove 36.

The supporting portion 34 is formed to have a larger diameter than the shaft portion 32. The outer circumference of the front end of the supporting portion 34 has the section corresponding to the section of the second inner diameter portion 14. Accordingly, being fit in the second inner diameter portion 14 of the container, the supporting portion 34 of the supporting shaft 30 is not rotated but only permitted to move in the axial direction. Formed in the supporting portion 34 is an accommodating recess 38 for receiving the lead element 50. Also formed in the outer circumference of the supporting portion 34 in a radial direction is a through hole 40 to receive the lead element 50. The through hole 40 is in fluid communication with the accommodating recess 38. The preferred number of the through hole 40 is in the range of 2 to 4, and this embodiment employed a pair of through holes 40. Preferably, the lead element 50 is formed by starting the injection of the raw material in melt state from the accommodating recess 38 and then solidifying the injected raw material. Since the raw material is also filled in the pair of through holes 40 in addition to the accommodating recess 38, the lead element 50 can be supported at the through holes 40 as the raw material solidifies. Accordingly, the lead element 50 is not escaped from the accommodating recess 38 when the lead element 50 is moved in the axial direction.

More specifically, the shaft portion 32 and the supporting portion 34 are in fluid communication with each other by a center hole 42 which is pierced through the center of the supporting shaft 30. As will be described later, the center hole 42 serves as a gateway for a nozzle which is inserted to inject the raw material of the lead element 50 therethrough. The nozzle is entered into the container 10, after being inserted through the rear end of the center hole 42 and then passed through the accommodating recess 38.

The lead element 50 has a leading end portion 52 in the shape of a frustum-cone.

Meanwhile, as the lead element 50 is formed by injecting raw material in melt state into the container 10, the shape of the lead element 50 is determined by the inner configuration of the interior of the container 10. Accordingly, the body of the lead element 50 has the section corresponding to the polygonal section of the second inner diameter portion 14, having plane faces 54 formed on the outer circumference corresponding to the faces 18 of the second inner diameter portion 18.

The adjustment member 70 is formed as a hollow member having one and the opposite ends open, and connected to the rear end of the container 10. From the rear toward the front direction, the adjustment member 70 includes a first cylinder portion 72 provided as a handle for rotation, a second cylinder portion 74 extended from the first cylinder portion 72 in a smaller diameter, a third cylinder portion 76 extended from the second cylinder portion 74 in a even smaller diameter and rotatably inserted into the rear end of the container 10, and a fourth cylinder portion 78 extended from the third cylinder portion 76 in a even smaller diameter.

Formed on the outer circumference of the leading end of the fourth cylinder portion 78 is an annular protrusion 80. The annular protrusion 80 is for locking with the annular protrusion 20 of the container 10 during the assembling of the adjustment member 70 with the rear end of the container 10, thereby preventing separation of the adjustment member 70 from the container 10. According to the preferred embodiment of the present invention, the fourth cylinder portion 78 has a plurality of axial cutaway grooves 82. The fourth cylinder portion 78 is divided into a plurality of resilient parts 84 by the cutaway grooves 82. The plurality of resilient parts 84 are bendable inward as well as outward in the radial direction, and thus allow the annular protrusion 80 thereof to be resiliently passed through the annular protrusion 20 of the container, and also to be resiliently locked with the annular protrusion 20 after having passed through the annular protrusion 20.

Formed on the inner circumference of the fourth cylinder portion 78 of the adjustment member 70 is a spiral protrusion 86 for being engaged with the spiral groove 36 of the supporting shaft 30. The spiral protrusion 86 is formed on the circumference of the fourth cylinder portion 78 by the distance corresponding to ¼~1 turn. This is because forming the spiral protrusion 86 too long will cause complex manufacturing process and high costs.

Another annular protrusion 88 is also formed on the outer circumference of the second cylinder portion 74. The annular protrusion 88 of the second cylinder portion 74 is for being engaged with an annular protrusion 98 of a cap which will be described later.

Further, there is an extended-diameter portion 73 formed on the inner circumference of the rear end of the first cylinder portion 72 of the adjustment member 70 to a predetermined depth. The extended-diameter portion 73 receives a plug 110 which will be described later.

The cap 90 is covered from the front direction of the container 10, thereby protecting the lead element 50. Formed inside the front end of the cap 90 is a recess 92 shaped in correspondence with the shape of the leading end of the lead element 50. The recess 92 is provided as a mold cavity for molding the leading end of the lead element 50. Further, around the recess 92 is formed an annular groove 94 for a fitting with the leading end of the container 10. In the proximity to the annular groove 94, an annular edge 96 is formed around the recess 92. The annular edge 96 is brought into tight contact with the first inner diameter portion 12 of the container 10.

As shown, the recess 92 of the cap 90 according to the preferred embodiment of the present invention is formed as a frustum-cone. The shape of the recess 92 decides the shape of the leading end 52 of the lead element 50. Albeit not shown, the recess 92 can be formed in various shapes such as hemisphere, semi-elliptic, or the like.

The annular protrusion 98 is formed on the inner circumference of the rear end of the cap 90. The annular protrusion 98 is connected with the annular protrusion 88 of the second cylinder portion 74 of the adjustment member 70. Accordingly, when the cap 90 is covered, the annular protrusion 8 is locked with the annular protrusion 88 of the adjustment member 70.

The plug is press-fitted to the rear end of the adjustment member 70, thereby blocking the adjustment member 70. The outer circumference 112 of the plug 110 is force-fitted with the extended-diameter portion 73 of the adjustment member 70. Formed in the center of the plug 110 is a protrusion 114 for being inserted into the center hole 42 of the supporting shaft 30. The plug 110 is assembled immediately after the injection of the raw material in melt state into the container 110. During the assembling process, the protrusion 114 of the plug 110 seals the center hole 42 of the supporting shaft 30, while the outer circumference 112 blocks the rear end of the adjustment member 70. As a result, the raw material in melt state injected inside of the container 10 is completely sealed off from the external atmosphere, and the influence by the difference between the surface temperature of the lead element 50 and the temperature of the interior is reduced. Accordingly, the deformation by the cooling is minimized.

Figure 3:
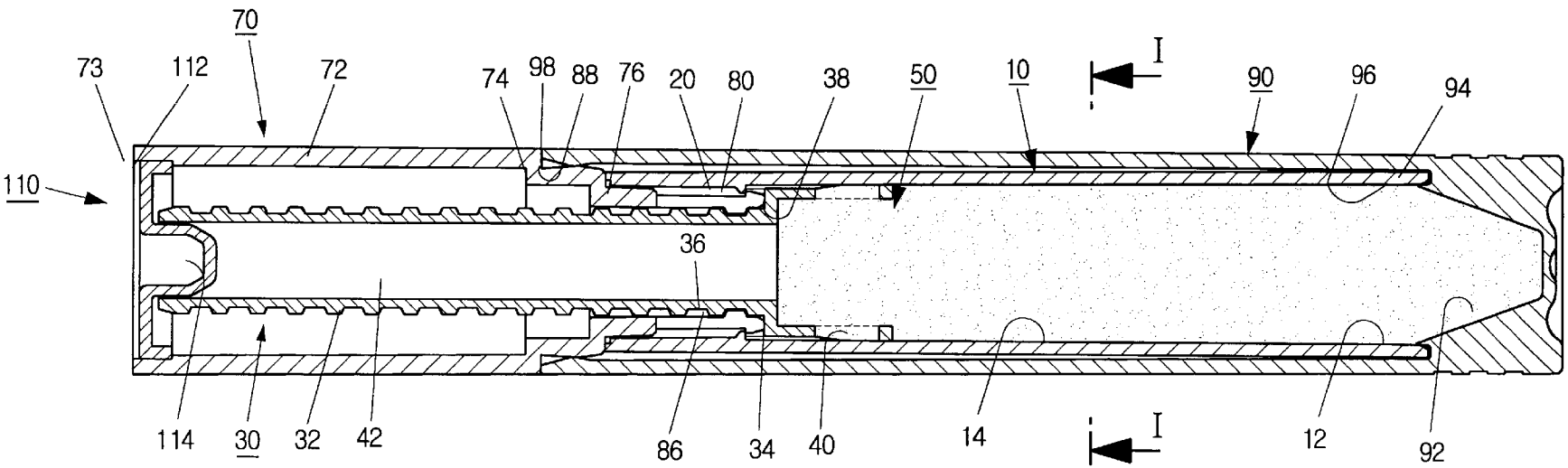
FIG. 3 is a sectional view showing the writing implement being assembled according to the preferred embodiment of the present invention.
Figure 4:
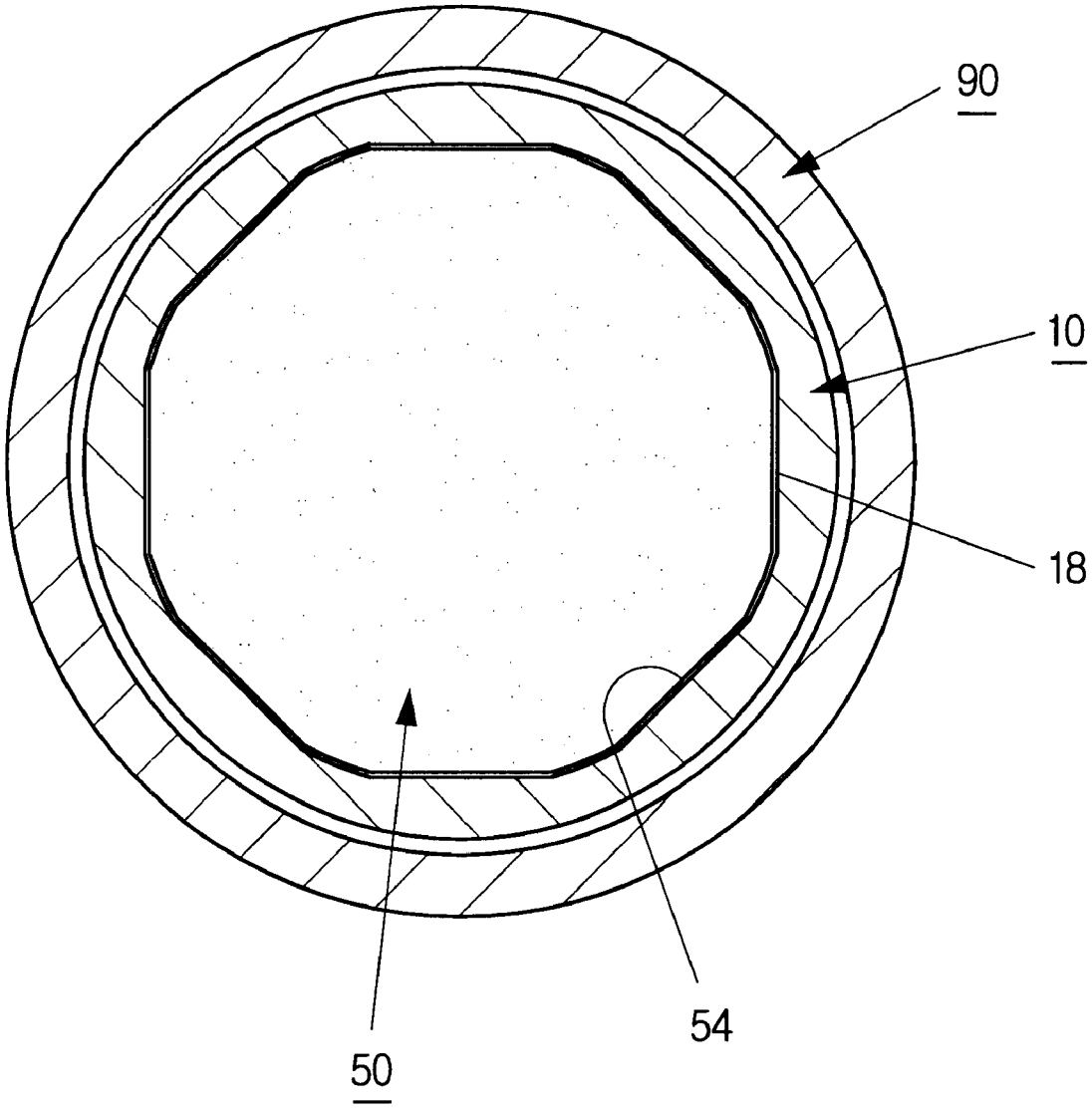
FIG. 4 is a sectional view taken along line I—I of FIG. 3.

Hereinbelow, the assembling process of the writing implement according to the present invention will be described with reference to FIGS. 1 through 4. FIGS. 3 and 4 are sectional views showing the structure of the writing implement assembled according to the present invention.

First, as shown in FIGS. 1 and 2, the adjustment member 70 is assembled into the rear end of the container 10. At this time, as shown in FIG. 3, the third cylinder portion 76 of the adjustment member 70 is inserted in the rear end of the container 10 with maintaining a predetermined gap from the inner circumference of the container 10, and the annular protrusion 80 at the leading end of the adjustment member 70 is locked with the annular protrusion 20 of the container 10. As a result, the adjustment member 70 is rotatably connected to the rear end of the container 10. Meanwhile, because the second cylinder portion 74 will be engaged with the cap 90 later, the second cylinder portion 74 of the adjustment member 70 is not inserted into the container 10.

With the container 10 and the adjustment member 70 being engaged as described above, the shaft portion 32 of the supporting shaft 30 is inserted into the container 10 from the front side. Since the second inner diameter portion 14 of the container 10 is formed to have the polygonal section, and since the supporting portion 34 of the supporting shaft 30 is formed to have the polygonal section corresponding to the section of the second inner diameter portion 14, the supporting shaft 30 is smoothly inserted into the container 10 simply by aligning the sections of the second inner diameter portion 14 and the supporting portion 34.

Meanwhile, when the shaft portion 32 of the supporting shaft 30 reaches the rear end of the container 10, the adjustment member 70 is rotated, causing the spiral groove 36 of the shaft portion 32 of the supporting shaft 30 to be engaged with the spiral protrusion 86 formed on the fourth cylinder portion 78 of the adjustment member 70. As a result, the shaft portion 32 of the supporting shaft 30 and the adjustment member 70 are engaged with each other.

Figure 5:
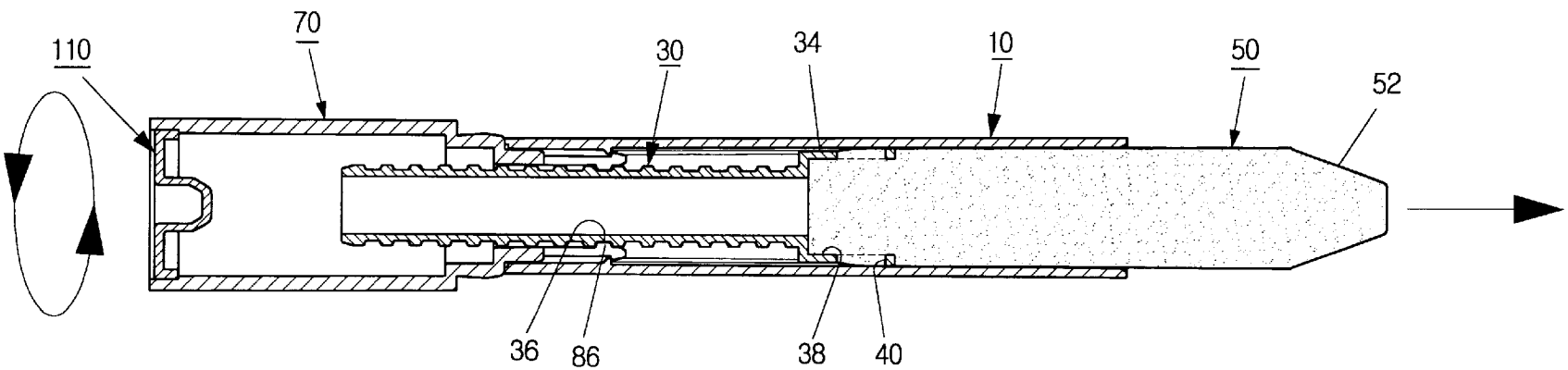
FIG. 5 is a sectional view showing the lead element being advanced for a predetermined distance with the cap of FIG. 3 being removed.

While the shaft portion 32 of the supporting shaft 30 is screw-engaged with the adjustment member 70, as shown in FIG. 5, the supporting portion 34 of the supporting shaft 30 having the polygonal section is surface-connected with the container 10 that also has the polygonal section, thereby being locked from rotating and only permitted to move in the container 10 in the linear direction. Accordingly, by rotating the adjustment member 70, the spiral protrusion 86 of the adjustment member 70 is moved along the spiral groove 36 of the supporting shaft 30, causing the supporting shaft 30 to be linearly moved in the container 10.

Meanwhile, as the lead element 50 completely solidifies in the container 10, the rear end of the lead element 50 is supported by the front end of the supporting shaft 30, while the outer circumference is in surface-contact with the interior of the container 10 which is in polyhedral shape. Accordingly, by the rotation of the adjustment member 70, the lead element 50 can be moved together with the supporting shaft 30 inside of the container in the axial direction.

Next, the cap 90 is covered over the container 10 from the front direction. As the annular protrusion 98, which is formed on the inner side of the rear end of the cap 90, is locked with the annular protrusion 88 formed on the second cylinder portion 74 of the adjustment member 70, the cap 90 is engaged with the adjustment member 70.

During the capping process, the front end of the container 10 is inserted into the annular groove 94 that is formed on the inner side of the end of the cap 90. Accordingly, the annular edge 96 formed between the recess 92 of the cap 90 and the annular groove 94 is surface-aligned with the first inner diameter portion 12 of the container 10. As a result, the inner circumference of the container 10 is smoothly connected with the recess 92 of the cap 90.

As described above, due to the presence of the center hole 42 pierced through the supporting shaft 30, the supporting shaft 30 is in fluid communication with the interior of the container 10, while the rear end of the adjustment member 70 is in open state. In other words, the interior of the container 10 is in fluid communication with the outside through the center hole 42 of the supporting shaft 30. Accordingly, it is possible to insert the injection nozzle for lead element molding into the container 10 from the rear direction through the center hole 42 of the supporting shaft 30, inject the raw material in melt state through the injection nozzle, and solidify the injected raw material into the lead element 50. Because the leading end 52 of the lead element 50 is molded to a shape corresponding to the shape of the recess 92 formed in the inner side of the end of the cap 90, the lead element 50 can have the leading end 52 of a smooth and complete shape.

Meanwhile, after the molding of the lead element 50, the plug 110 is engaged with the rear end of the adjustment member 70. The plug 110 is force-fitted into the extended-diameter portion 73 of the adjustment member 70. During the force-fitting of the plug 110, the center protrusion 114 of the plug 110 is inserted into the center hole 42 of the supporting shaft 30, thereby preventing the raw material in melt state from being exposed to the external air.

FIG. 5 is a sectional view for illustrating the operation of the writing implement according to the present invention, showing the lead element 50 being advanced forward from the container 10. For an easy reference, the cap 90 is removed in FIG. 5.

First, as the user grabs the container 10 and rotates the adjustment member 70 in a certain direction, the spiral protrusion 86 of the adjustment member 70 is rotated along the spiral groove 36 of the supporting shaft 30.

Since the supporting shaft 30 is connected with the container 10 in a manner that the polygonal sections thereof are aligned with each other, the supporting shaft 30 is only permitted to move linearly in the axial direction of the container 10, while being prevented from being rotated. Accordingly, the force that moves the spiral protrusion 86 along the spiral groove 36 acts as a propelling force that moves the supporting shaft 30 in the axial direction. Hence, the supporting shaft 30 is moved in the axial direction when the adjustment member 70 is rotated.

Further, since the lead element 50 is molded in accordance with the inner configuration of the container 10, the lead element 50 also has the polygonal section and thus is in surface-contact with the container 10. Accordingly, the lead element 50 is moved in the axial direction by the movement of the supporting shaft 30, and escaped out of the container 10.

Meanwhile, after the writing and thus when it is required to retreat the lead element 50 into the container 10, the adjustment member 70 is rotated in the direction opposite to the lead element advancing direction. All the movement and mechanical inter-operations during the retreat are identical to those during the advance, except that they are carried in opposite directions.

Accordingly, attention is invited to the following operations in relation to the retreat of the lead element 50.

As described above, the supporting portion 34 of the supporting shaft 30 has the accommodating recess 38 and the through holes 40 in fluid communication with the accommodating recess 38. As the lead element 50 is filled in both the accommodating recess 38 and the through holes 40, the lead element 50 can be stably secured in the supporting portion 34. More specifically, a friction usually occurs between the surface of the lead element 50 and the inner surface of the container 10 during the movement of the lead element 50 in the axial direction, acting as a resisting force against the movement of the lead element 50. Being subject to such frictional force, the lead element 50 is apt to escape from the supporting portion 34 of the supporting shaft 30. According to the present invention, such problem can be prevented by the structure that fills the lead element 50 in the through holes 40 of the supporting portion 34. Since the lead element 50 is stably supported by this structure, supporting of the lead element 50 is reinforced, and therefore, the separation of the lead element 50 can be prevented.

Meanwhile, due to a rather inefficient structure of the conventional case that connects the container and the lead element through the use of protrusions and corresponding grooves formed in the axial direction, the lead element would severely break during the advance and retreat of the lead element, and the fragments of the broken lead element caused problems.

The above problems can be solved by the present invention. That is, according to the preferred embodiment of the present invention, since the lead element 50 and the container 10 are connected with each other in a manner that the polygonal-sections thereof are aligned with each other, no fragments from the breakage occur during the advance or retreat of the lead element 50 with respect to the container 10.

FIGS. 6A through 6D show the process of molding the lead element 50 by injecting the raw material in melt state according to the present invention.

As shown in FIGS. 6A through 6D, the writing implement is made to stand upright, with its rear side facing upward, so that the injection nozzle 150 can be inserted from the rear direction of the writing implement.

The lead element 50 is molded in a state that the supporting shaft 30, the adjustment member 70 and the cap 90 are assembled with the container 10. In other words, the molding of the lead element 50 is carried out with all the parts excluding the plug 110 are assembled in place. With the supporting shaft 30, the adjustment member 70 and the cap 90 being assembled with the container 10, the inner configuration of the first and the second inner diameter portions 12 and 14, of the supporting portion 34 of the supporting shaft 30, and of the recess 90 of the cap 90 defines the molding cavity, and the lead element 50 is molded into the shape corresponding to the inner configuration of the molding cavity.

The center hole 42 is pierced through the supporting shaft 30, into fluid communication with the interior of the container 10, and the adjustment member 70 is formed as a cylinder whose one and the opposite ends are open. Since the adjustment member 70 is open at its rear end, the molding cavity for molding the lead element 50 is in fluid communication with the outside through the supporting shaft 30. Accordingly, it is possible to insert the injection nozzle 150 from the rear direction of the writing implement, and inject the raw material of the lead element 50 through the injection nozzle 150.

Figure 6A:
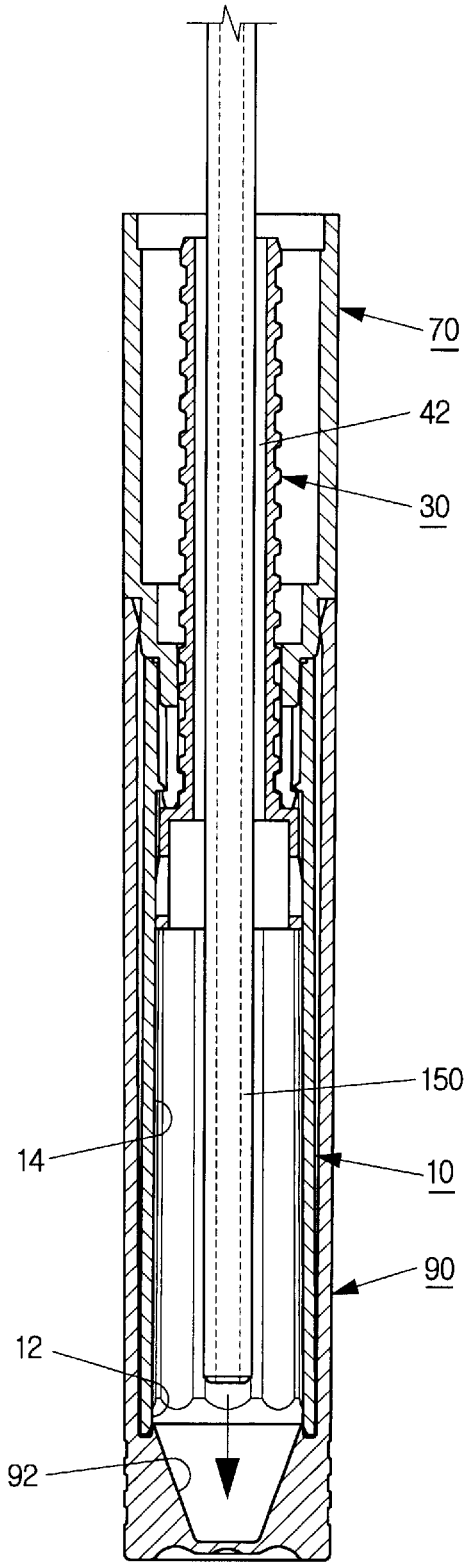
FIG. 6A is a sectional view showing the writing implement before the injection of raw material in melt state into a container.
Figure 6B:
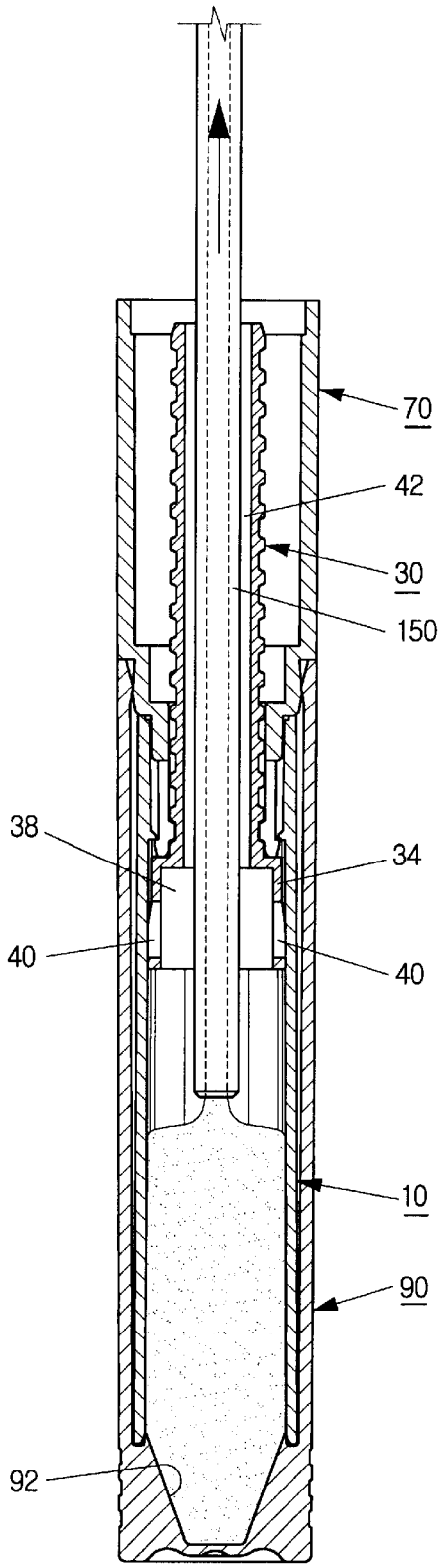
FIG. 6B is a sectional view showing the writing implement in which a certain amount of raw material in melt state is injected into the container.

Referring to FIG. 6A, the injection nozzle 150 is inserted into the molding cavity from the rear side of the writing implement and through the center hole 42 of the supporting shaft 30.

When the injection nozzle 150 is advanced to the recess 92 of the cap 90, the raw material of the lead element 50 in melt state is started to be injected into the molding cavity, with the injection nozzle 150 being slowly pulled out toward the rear direction of the writing implement.

Accordingly, the raw material in melt state is filled in the container 10, starting from the recess 92 of the cap 90. Since the raw material is slowly injected, the raw material is completely filled in the container 10 without leaving any room in the recess 92. In other words, foam is less likely to be formed in the raw material, and there is little deformation especially at the recess 92 during cooling process. As a result, the lead element 50 can be molded to have a leading end 52 of a smooth and complete configuration.

Figure 6C:
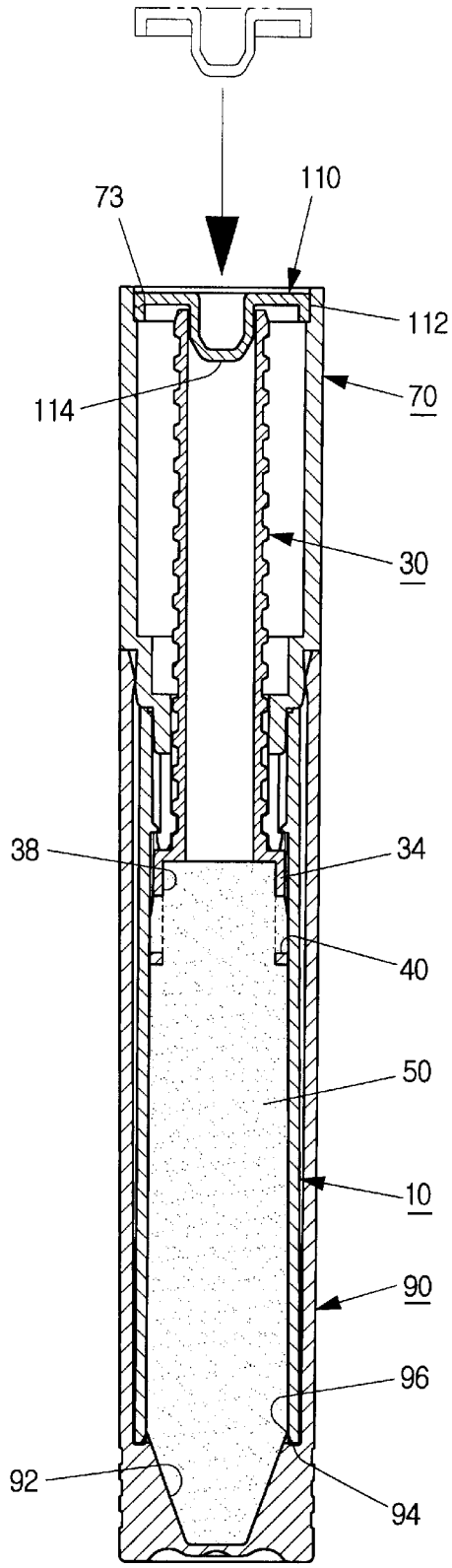
FIG. 6C is a sectional view showing a plug being assembled with the container in which the raw material is completely injected.

FIG. 6C shows the raw material being completely injected. As shown in FIG. 6C, the raw material in melt state is filled in the container 10 throughout the container 10 to the supporting portion 34 of the supporting shaft 30. As described above, there is the accommodating recess 38 formed in the supporting portion 34 of the supporting shaft 30, and the through holes 40 formed opposite to each other and in fluid communication with the accommodating recess 38, and the raw material is filled in both the accommodating recess 38 and the through holes 40.

After the injection, the plug 110 is assembled to the rear end of the adjustment member 70. During the assembling, the outer circumference 112 of the plug 110 is press-fitted in the extended-diameter portion 73 of the adjustment member 70. Also, the center protrusion 114 of the plug 110 is inserted in the center hole 36 of the supporting shaft 30, preventing the injected raw material in melt state from being exposed to the external temperature. The molding cavity is also sealed at a front side of the writing implement because of the fitting of the leading end of the container 10 in the annular groove 94 of the cap 90. Since the raw material solidifies in the molding cavity under uniform environment, deformation thereof is minimized.

Figure 6D:
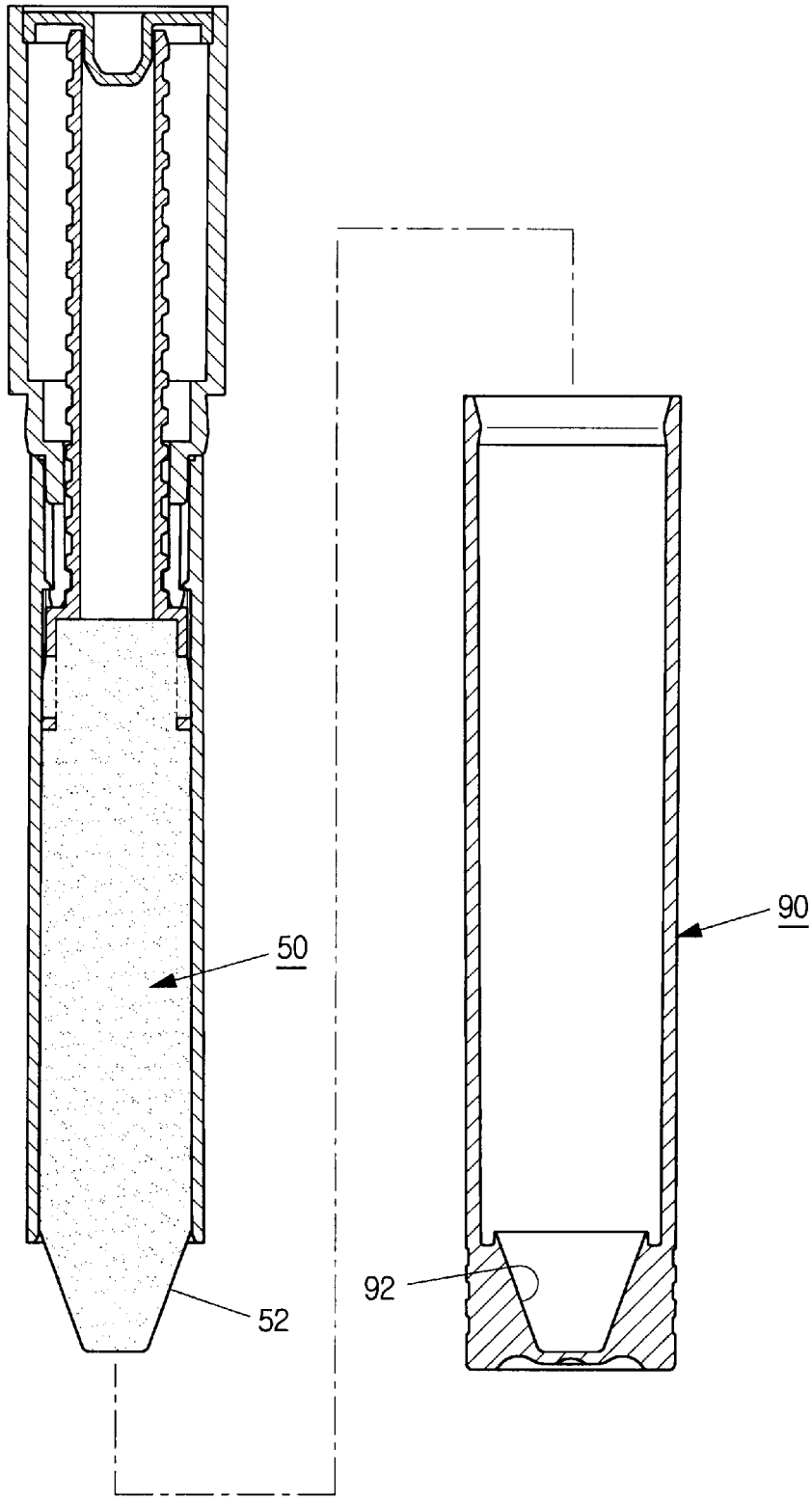
FIG. 6D is a sectional view showing the writing implement with the cap of FIG. 6C being removed.

Referring to FIG. 6D, after the solidification of the raw material, the leading end 52 of the lead element 50 is exposed as the cap 90 is removed. Since the leading end 52 of the lead element 50 is molded in accordance with the configuration of the recess 92 formed in the inner side of the end of the cap 90, the leading end 52 has a smooth and complete configuration.

As described above, the injection of the raw material is carried out after all the parts except for the plug 110 are assembled in place. That is, the raw material is injected after the supporting shaft 30, the adjustment member 70 and the cap 90 are assembled with one another. Conventionally, the cap, or supporting means and rotating means were assembled after the injection of the raw material through a manual work. Hence, the manufacturing process was complex, and it was also difficult to automate the assembly line. According to the present invention, the center hole 42 is formed in the supporting shaft 30 in fluid communication with the molding cavity, and the adjustment member 70 is made to have two open ends, enabling the injection of the raw material with all the parts being assembled in place. Accordingly, the number of works is reduced during the manufacture, and automation of assembly line can be easily achieved.

Further, in the conventional cases, it was difficult to shape the leading end 52 of the lead element 50 as desired, because the raw material was injected from the front direction of the cap 90. Accordingly, the leading end 52 of the lead element 50 had to be re-processed after the solidification of the raw material. Unlike the conventional cases, there is the recess 92 formed in the inner side of the end of the cap 90 according to the present invention, and the raw material is injected starting from the recess 92 of the cap 90. Since the leading end 52 is shaped in accordance with the configuration of the recess 92 of the cap 90, the leading end 52 can have a smooth and complete configuration.

Although the present invention has been described with reference to a writing implement, this should not be considered as limiting. Accordingly, the present invention can also be applied in other types of products such as lipsticks that use the bar type material by advancing and retreating the same.

As described above, with the writing implement having the bar type lead element 50 and the molding method of the lead element 50 therein according to the present invention, the raw material in melt state can be injected with all the main parts being assembled with the container 10. As a result, the manufacturing process becomes simplified, and the automation of assembly line can be achieved easily.

Further, according to the present invention, the recess 92 having a certain configuration desired for the shape of the leading end 52 of the lead element 50 is formed in the inner side of the end of the cap 92. As the raw material is injected in the container 10, it helps the simplification of the manufacturing process and assembly line automation. Additionally, the leading end 52 of the lead element 50 can be molded to have a smooth and complete shape as that of the configuration of the recess 92 of the cap 90.

Further, since the supporting shaft 30 and the lead element 50 have the polygonal sections corresponding to the inner circumference of the container 10, the supporting shaft 30 and the lead element 50 are not rotated inside of the container 10, but moved linearly in axial direction. Accordingly, deformation by the breakage of the lead element 50 due to friction with the container 10 during advance and retreat, and the fragments from the breakage can be prevented.

Finally, additional advantage of the present invention is that the writing implement according to the present invention has an improved appearance because it has the lead element 52 of a polyhedral shape.

While the invention has been shown and described with reference to an embodiment thereof, it will be understood by those skilled in the art that various changes in form and details may be made therein without departing from the spirit and scope of the invention as defined by the appended claims.

What is claimed is:

1. A writing implement having a bar type lead element that is formed as a raw material in melt state solidifies, the writing implement comprising:

a container formed as a hollow member having one and opposite ends being open;

a supporting shaft inserted in the container to be moved therein linearly in an axial direction, the supporting shaft being formed as a hollow member having a center hole pierced therethrough; and an adjustment member movably connected to a rear end of the container to be rotated, the rotation of the adjustment member causes the supporting shaft to be linearly moved in the container, the adjustment member being formed as a hollow member having one and opposite ends being open to be in fluid communication with the center hole, wherein the raw material of the lead element is injected into the container from a rear end of the adjustment member through the center hole, and solidifies into the lead element, and the lead element is supported on the front end of the supporting shaft at its rear end, and moved in accordance with the movement of the supporting shaft.

2. The writing implement of claim 1, wherein the supporting shaft is screw-engaged with the adjustment member to be linearly moved in the axial direction inside of the container in accordance with the rotational movement of the adjustment member.

3. The writing implement of claim 2, wherein the supporting shaft comprises a shaft portion having a spiral groove formed in an outer circumference, and a supporting portion connected to a front end of the shaft portion with an outer circumference being in contact with the inner circumference of the container and not allowed to rotate but only allowed to move in a linear direction, and the adjustment member comprises a spiral protrusion formed in a front end for being inserted in the spiral groove, wherein the spiral protrusion moves along the spiral groove by the rotation of the adjustment member, and the supporting shaft is not rotated but moved linearly in the axial direction inside of the container.

4. The writing implement of claim 3, wherein the outer circumference of the supporting portion and the inner circumference of the container are formed in a polygonal shape, wherein the supporting portion, being inserted in the container, is only allowed to move in the axial direction.

5. The writing implement of claim 3, wherein the supporting portion comprises an accommodating recess for accommodating a rear end of the lead element, and a through hole in fluid communication with the accommodating recess, the accommodating recess and the through hole being filled with a raw material of the lead element.

6. The writing implement of claim 1, further comprising a cap formed as a hollow member having an open rear end and a closed front end, the cap accommodating the container therein.

7. The writing implement of claim 6, wherein the cap comprises a recess formed in an inner side of the front end, having a shape corresponding to a shape of the leading end of the lead element.

8. The writing implement of claim 1, further comprising a plug for sealing the rear end of the adjustment member, the plug having a projection protruding from the center for being inserted into the center hole of the supporting shaft.

9. A method for forming a lead element, comprising the steps of:

rotatably assembling an adjustment member to a rear end of a container, the container being formed as a hollow member having one and the opposite end open, the adjustment member being formed as a hollow member having one and the opposite end open;

inserting a supporting shaft in the container from the front direction in a manner such that the supporting shaft is moved in the container, the supporting shaft being formed as a hollow member having a hole being pierced therethrough;

screw-engaging the adjustment member with the supporting shaft in a manner such that the supporting shaft is linearly moved in the container in accordance with the rotation of the adjustment member;

sealing the container by covering the front end of the container with a cap;

inserting a nozzle in the container through the supporting shaft from the rear direction of the adjustment member, the nozzle for injection of a raw material of the lead element in melt state;

injecting the raw material of the lead element in melt state in the container through the nozzle; and forming a bar type lead element by solidifying the raw material of the lead element injected into the container.

10. The method of claim 9, wherein the lead element is formed in the shape corresponding to the inner shape of the container, with a leading end being formed in accordance with a recess of the cap that is formed in an inner side of an end of the cap, and a rear end being secured to the front end of the supporting shaft.

11. The method of claim 9, wherein the raw material of the lead element in melt state is injected into the container, with the nozzle, which is inserted to the proximity of the front end of the container, being retreated from the proximity of the front end of the container to the front end of the supporting shaft.

12. The method of claim 9, wherein, after the injection of the raw material, the rear end of the adjustment member is sealed by a plug.

* * * * *